US012734637B2

(12) United States Patent
Byun et al.

(10) Patent No.: US 12,734,637 B2
(45) Date of Patent: Sep. 15, 2026

(54) MEMBRANE COATING COMPOUND FOR CHEMICAL MECHANICAL POLISHING PROCESS, MEMBRANE INCLUDING THE SAME, AND POLISHING APPARATUS INCLUDING THE SAME

(71) Applicant: SAMSUNG ELECTRONICS CO., LTD., Suwon-si (KR)

(72) Inventors: Yearin Byun, Suwon-si (KR); Inkwon Kim, Suwon-si (KR); Sangkyun Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 445 days.

(21) Appl. No.: 18/219,222

(22) Filed: Jul. 7, 2023

(65) Prior Publication Data

US 2024/0189960 A1 Jun. 13, 2024

(30) Foreign Application Priority Data

Dec. 13, 2022 (KR) ..... 10-2022-0174043

(51) Int. Cl.
*B24B 37/24* (2012.01)
*B24B 37/22* (2012.01)

(52) U.S. Cl.
CPC ..... *B24B 37/24* (2013.01); *B24B 37/22* (2013.01)

(58) Field of Classification Search
CPC ..... B24B 37/24; B24B 37/22; B24B 37/10; B24B 37/30; C09D 179/02; H01L 21/67092
See application file for complete search history.

(56) References Cited

U.S. PATENT DOCUMENTS

| | | | | |
|---|---|---|---|---|
| 5,913,719 | A | 6/1999 | Hasegawa et al. | |
| 10,092,928 | B2 | 10/2018 | Viala et al. | |
| 2011/0256813 | A1* | 10/2011 | Fletcher | B24B 37/28 51/298 |
| 2018/0369991 | A1* | 12/2018 | Yan | C09K 3/1436 |
| 2021/0115238 | A1* | 4/2021 | Williams | C09D 179/02 |
| 2021/0277272 | A1* | 9/2021 | Yasuda | C08L 83/04 |

FOREIGN PATENT DOCUMENTS

| | | | | |
|---|---|---|---|---|
| JP | 2001-144052 | A | 5/2001 | |
| JP | 6470976 | B2 | 2/2019 | |
| KR | 100576822 | B1 * | 5/2006 | B24B 41/061 |
| KR | 10-1040333 | B1 | 6/2011 | |

OTHER PUBLICATIONS

Ryu et al. Polydopamine surface chemistry: a decade of discovery. ACS Appl. Mater. Interfaces, 10, 7523-7540 (Year: 2018).*
KR 100576822_Machine Translation (Year: 2006).*

* cited by examiner

*Primary Examiner* — Amber R Orlando
*Assistant Examiner* — Anastasia A. Kuvayskaya
(74) *Attorney, Agent, or Firm* — Muir Patent Law, PLLC

(57) ABSTRACT

A membrane coating compound for a chemical mechanical polishing process, a membrane structure for a chemical mechanical polishing process, and a polishing apparatus for a chemical mechanical polishing process in which a wafer is holdable under pressure on the polishing apparatus, the membrane coating compound includes a functional group capable of hydrogen bonding.

20 Claims, 7 Drawing Sheets

(a)

MEMBRANE COATING COMPOUND FOR CHEMICAL MECHANICAL POLISHING PROCESS, MEMBRANE INCLUDING THE SAME, AND POLISHING APPARATUS INCLUDING THE SAME

CROSS-REFERENCE TO RELATED APPLICATION

This application claims priority to and the benefit of Korean Patent Application No. 10-2022-0174043 filed in the Korean Intellectual Property Office on Dec. 13, 2022, the entire contents of which are incorporated herein by reference.

BACKGROUND

1. Field

Embodiments relate to a membrane coating compound for a chemical mechanical polishing (CMP) process, a membrane including the same, and a polishing apparatus including the same.

2. Description of the Related Art

CMP, an abbreviation for Chemical Mechanical Polishing, is a process of polishing a surface of a wafer (e.g., an object to be processed) to be flat by using chemical reactions and mechanical force during a semiconductor manufacturing process.

SUMMARY

The embodiments may be realized by providing a membrane coating compound for a chemical mechanical polishing (CMP) process, the membrane coating compound including a functional group capable of hydrogen bonding.

The embodiments may be realized by providing a membrane structure for a chemical mechanical polishing (CMP) process, the membrane structure including a membrane; and a coating layer on a surface of the membrane, a wafer being fixable on the coating layer, wherein the coating layer includes a compound including a functional group capable of hydrogen bonding, and the wafer is fixable by hydrogen bonding between the compound of the coating layer and the wafer.

The embodiments may be realized by providing a polishing apparatus for a chemical mechanical polishing process in which a wafer is holdable under pressure on the polishing apparatus, the polishing apparatus including a carrier; a membrane below the carrier; a coating layer between the membrane and the wafer; and a spindle mechanism that is coupled to the carrier and is rotatable, wherein the coating layer includes a compound containing a functional group capable of hydrogen bonding.

BRIEF DESCRIPTION OF THE DRAWINGS

Features will be apparent to those of skill in the art by describing in detail exemplary embodiments with reference to the attached drawings in which.

DETAILED DESCRIPTION

Figure 1:
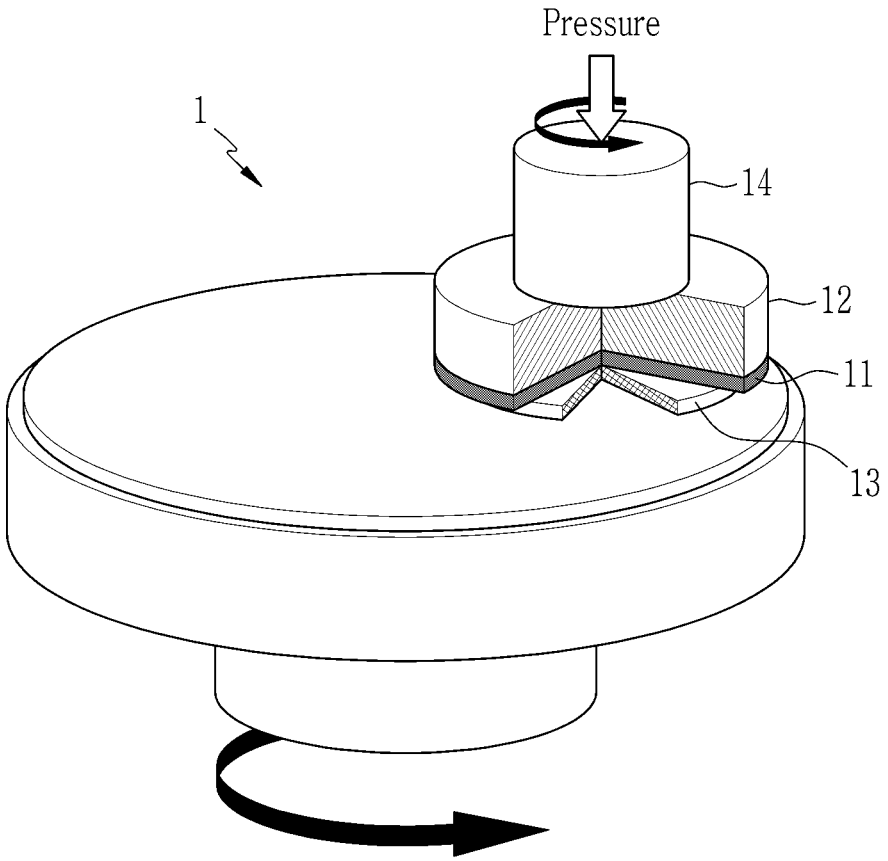
FIG. 1 illustrates a schematic view of a polishing apparatus according to an embodiment.

FIG. 1 illustrates a schematic view of a polishing apparatus according to an embodiment.

As can be seen in FIG. 1, a polishing apparatus 1 according to an embodiment may include a carrier 12 for holding the wafer 13 under pressure (e.g., on which the wafer 13 is holdable), a membrane 11 below the carrier 12, a coating layer (15, see FIG. 2) between the membrane 11 and the wafer 13, and a spindle mechanism 14 that is connected to the carrier 12 and is rotatable.

In an implementation, the coating layer 15 may include a compound including a functional group capable of hydrogen bonding.

Some membranes may be made of a silicon polymer compound, e.g., polysiloxane, and, because of the weak Van der Waals-based bonding force between the membrane and a rear surface of the wafer, wafer separation and breakage could often occur during polishing.

The adhesion of the membrane to the wafer may be improved through hydrogen bonding. As a result, it is possible to help prevent separation and breakage of the wafer.

As a result, it is possible to expect effects of improving semiconductor productivity and reducing production cost.

The technology according to the embodiment may be applied to all suitable CMP equipment including membranes. The membrane for the CMP may press the rear surface of the wafer to maintain a uniform pressure between the wafer and a CMP pad, and may also serve to chuck or hold the wafer by applying negative pressure.

The functional group capable of hydrogen bonding may include a functional group having a catechol structure. This structure may help achieve effective hydrogen bonding due to a plurality of hydroxy functional groups.

In an implementation, the functional group capable of the hydrogen bonding may further include an amine group. The hydrogen bonding may be provided to both the membrane and the wafer, and the compound included in the coating layer may have many functional groups capable of symmetrically hydrogen bonding.

In an implementation, the compound may include, e.g., dopamine, tyrosine, dihydroxyphenylalanine, norepinephrine, epinephrine, normetanephrine, 3,4-dihydroxyphenylalanine, a 3,4-dihydroxyphenylacetic acid, a tannic acid, a pyrogallic acid, or a combination thereof. As used herein, the term "or" is not an exclusive term, e.g., "A or B" would include A, B, or A and B.

In an implementation, the compound may be a polymer having a molecular weight of, e.g., 1,000 to 100,000.

The polymer compound may include a polymer or copolymer of, e.g., dopamine, tyrosine, dihydroxyphenylalanine, norepinephrine, epinephrine, normetanephrine, 3,4-dihydroxyphenylalanine, a 3,4-dihydroxyphenylacetic acid, a tannic acid, a pyrogallic acid, or a combination thereof.

In an implementation, the compound in the coating layer may include, e.g., polydopamine.

Figure 2:
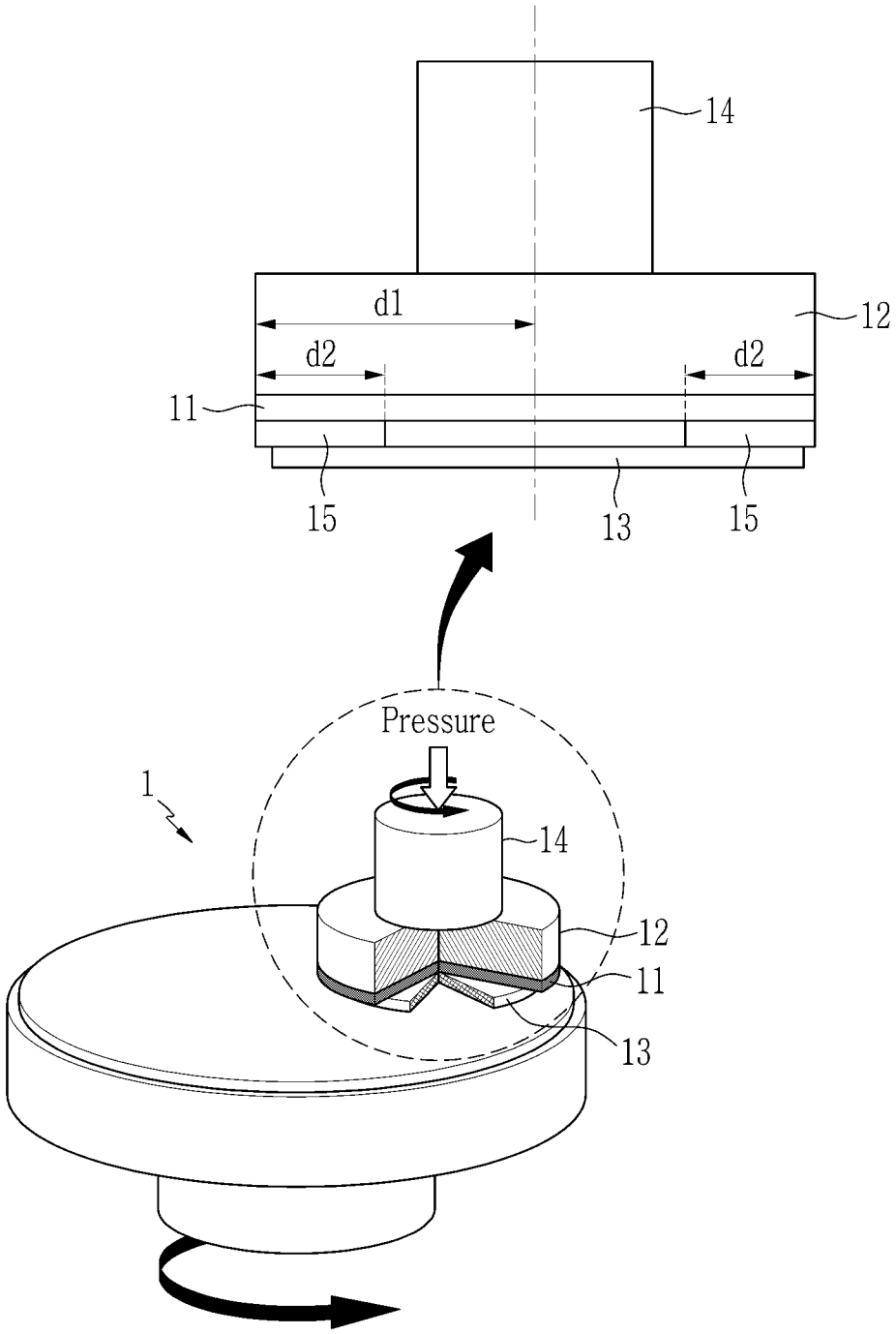
FIG. 2 illustrates a cross-sectional view of a membrane-related structure in the polishing apparatus of FIG. 1.

FIG. 2 illustrates a cross-sectional view of a membrane-related structure for a CMP process according to an embodiment.

Referring to FIG. 2, it may be seen that the coating layer 15 may be under the membrane 11 to be combined or coupled with the wafer 13. In an implementation, the coating layer 15 may be on a portion of the surface of the membrane 11. In an implementation, the coating layer 15 may be on only a portion of the surface of the membrane 11.

This makes it possible to form a chuck and facilitate control of the wafer.

In an implementation, a ratio of d2 (e.g., a radial width of the coating layer 15) to d1 (e.g., a radial width or radius of the membrane 11) in FIG. 2 may be 1/100 to 50/100. In an implementation, it may be 5/100 to 30/100, or 5/100 to 20/100. This may be appropriately adjusted according to a size of the wafer and a material of the membrane.

Figure 3:
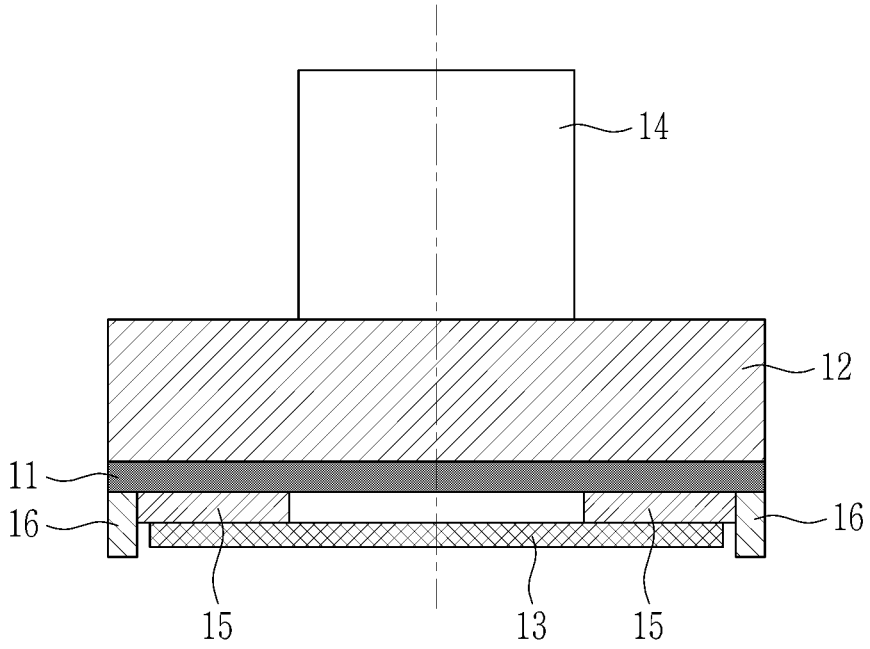
FIG. 3 illustrates a cross-sectional view of a membrane structure according to another embodiment.

FIG. 3 illustrates a cross-sectional view of a structure including an additional retainer 16. In an implementation, the retainer 16 may be included and may help reduce or prevent separation of the wafer.

The retainer 16 may have a shape of a ring on a lower portion or lower lateral surface of the membrane 11.

Figure 4:
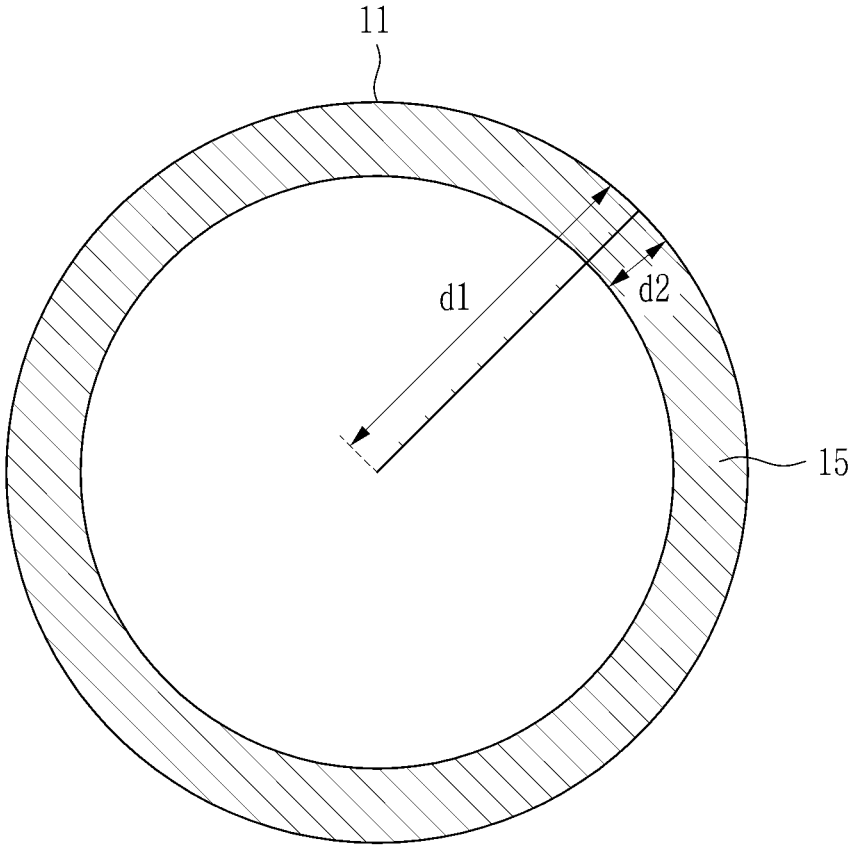
FIG. 4 to FIG. 6 illustrate plan views of a lower portion of a membrane according to an embodiment.

FIG. 4 illustrates a lower plan view of the membrane in or on which the coating layer is present. As shown in FIG. 4, the coating layer 15 may be at or on an end portion (e.g., outer edge) of the membrane 11. In an implementation, the ratio of d1 and d2 may be as described above.

In an implementation, an area of the coating layer 15 may be, e.g., 10 to 50 area %, based on a total area (100 area %) of the membrane 11. In an implementation, area of the coating layer 15 may be, e.g., 10 to 40 area %, or 30 to 40 area %, based on the total area of the membrane 11.

Compared to coating the entire surface of the membrane 11 with the coating layer 15 (e.g., 100 area %), the area of the coating layer 15 may be appropriately controlled according to the material and process characteristics of the membrane 11 within a range that it is easy to control the process efficiency and the wafer 13.

Figure 5:
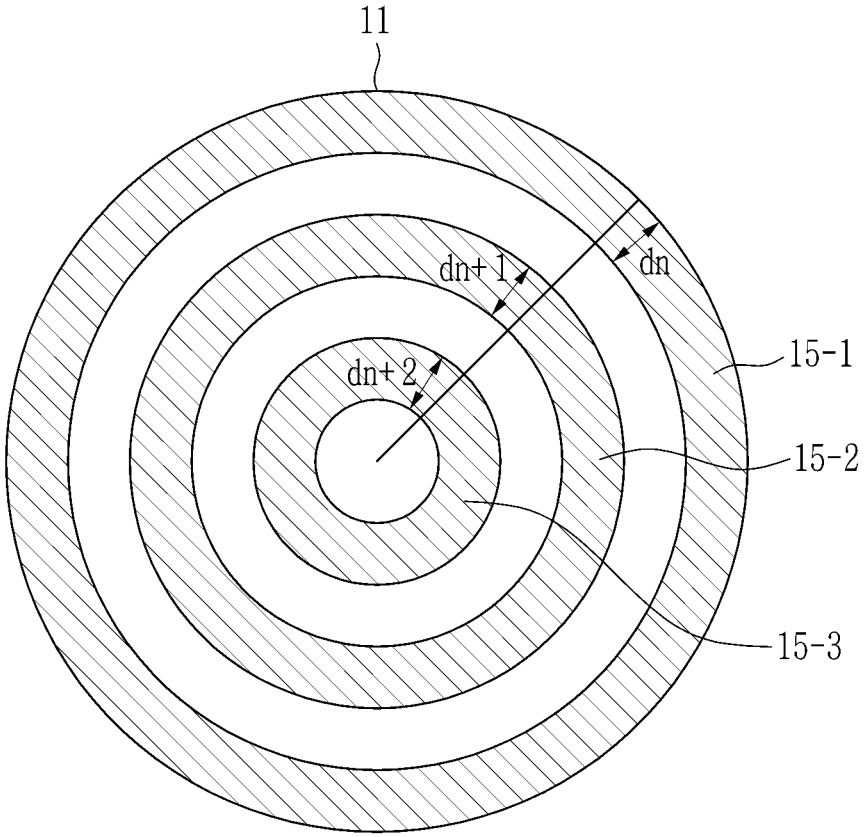

FIG. 5 illustrates a lower plan view of a membrane 11 including a coating layer thereon according to another embodiment. The coating layer may include a coating layer (e.g., edge coating layer) 15-1 at or on an outer edge thereof, and further include additional coating layers (e.g., inner coating layers) 15-2 and 15-3 at a core (e.g., proximate to a center) of the membrane 11 at predetermined intervals (e.g., inwardly radially spaced from the outer edge of the membrane 11 such that the edge coating layer 15-1 and the inner coating layers 15-2 and 15-2 are arranged in concentric circles of decreasing radius).

In an implementation, the inner coating layers 15-2 and 15-3 may help provide improved hydrogen bonding to be expected to improve adhesion.

Widths (e.g., radial widths) dn+1 and dn+2 of the inner coating layers 15-2 and 15-3 may be smaller than the radial width dn of the edge coating layer 15-1. With this width control, it is possible to help secure effective internal chuck formation and easy control of the wafer 13.

Figure 6:
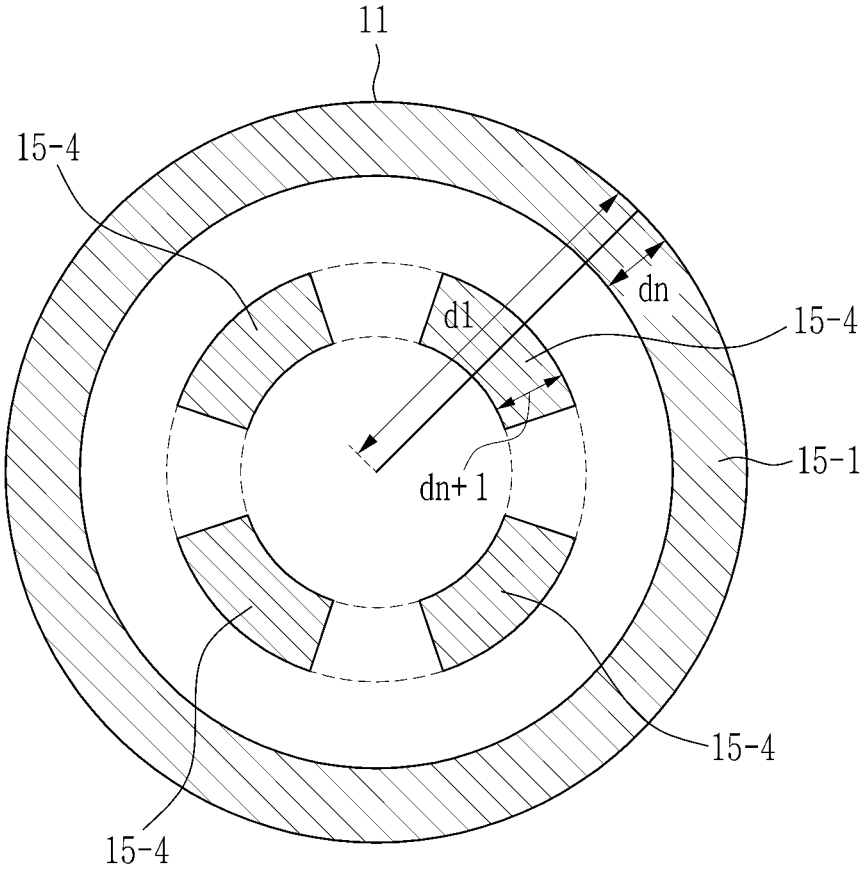

FIG. 6 illustrates a lower plan view of a membrane 11 including a coating layer thereon according to another embodiment. The coating layer may include a coating layer (e.g., edge coating layer) 15-1 at or on an outer edge thereof, and further include additional coating layers (e.g., inner coating layers) 15-4 at a core (e.g., proximate to the center) of the membrane 11 inwardly radially spaced from the outer edge of the membrane 11. The inner coating layers 15-4 proximate to the center the membrane 11 may be spaced apart from each other (e.g., circumferentially spaced apart from each other such that the inner coating layers 15-4 form a dashed circle on the membrane 11). Such a structure may facilitate attachment and detachment of the wafer 13.

The following Examples and Comparative Examples are provided in order to highlight characteristics of one or more embodiments, but it will be understood that the Examples and Comparative Examples are not to be construed as limiting the scope of the embodiments, nor are the Comparative Examples to be construed as being outside the scope of the embodiments. Further, it will be understood that the embodiments are not limited to the particular details described in the Examples and Comparative Examples.

Example

To form polydopamine, a dopamine chloride solution serving as a monomer was applied to the membrane.

By adjusting a pH of the applied solution to 7.5 or higher, the membrane was coated at the same time the polydopamine was formed. In this case, a value of the coated d2 (e.g., a radial width of the coating layer) was 3.75 cm, and it was controlled so that the coating layer covered 44 area %, based on the entire area of the membrane. A thickness of the coating layer was 4 mm.

Experimental Results

An evaluation was conducted by using the polydopamine-coated membrane of the Example, and a comparative membrane.

Figure 7:
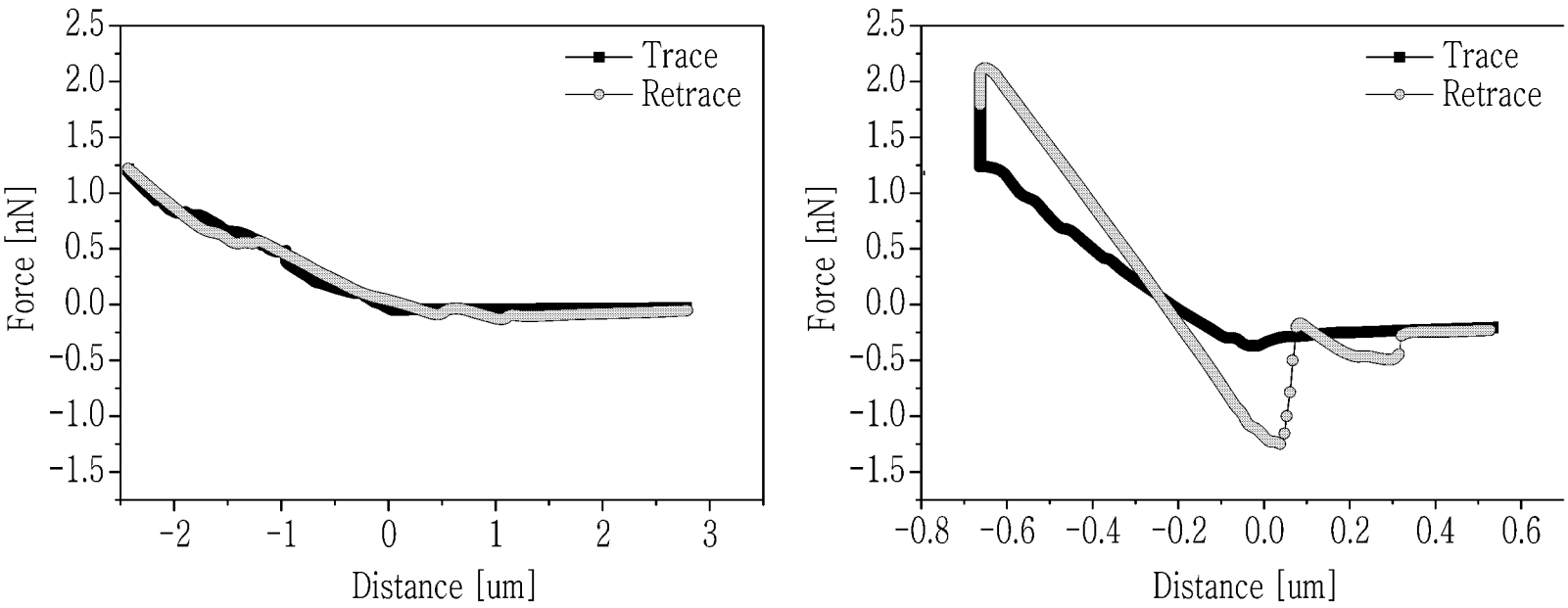
FIG. 7 illustrates adhesion test results of an example and a comparative example.

In order to check the adhesion with the silicon wafer, an adhesion test was performed as shown in FIG. 7. The test was performed by measuring the force-distance curve (F-D curve) between the membrane before and after coating and the AFM tip made of a Si material.

In the case of the comparative membrane, the adhesion with Si was $60*10^{-18}$ nN due to weak Van der Waals bonding. On the other hand, in the case of the polydopamine-coated membrane of the Example, the adhesion with the Si Tip was $480*10^{-18}$ nN, e.g., increased by 8 times, due to strong hydrogen bonding.

When the membrane according to an embodiment with improved adhesion is applied to a CMP equipment, wafer separation and breakage may be prevented, thereby significantly improving semiconductor productivity and reducing production costs.

By way of summation and review, properties of a membrane used in a semiconductor CMP process may be controlled to help increase the surface elasticity and adhesiveness of a contact surface with the wafer.

In a process in which a size of the wafer is small, adhesion to the wafer may be good even without surface treatment on the membrane, so there may not be issues in controlling adhesion and smoothness during wafer processing.

As the size of the wafers becomes larger, it could be difficult to improve the adhesion of the surface thereof only with the material of the membrane. Accordingly, a method for improving a slip property and adhesiveness of the membrane surface may be considered.

One or more embodiments may provide a chemical mechanical polishing apparatus, in order to address an increase in process difficulty along with an increase in difficulty in semiconductor product technology development.

According to the embodiment, the membrane coating compound for the CMP process may effectively prevent slip during a CMP process through hydrogen bonding with a wafer. In addition, process control may be easy due to proper adhesion, and process efficiency may be improved by forming a chuck on a wafer through pressure reduction.

In another embodiment, a membrane, on which such a coating compound is disposed, may be provided. When using such a membrane, it is easy to control a wafer in a CMP process.

In another embodiment, a polishing apparatus including the aforementioned membrane is provided. The polishing apparatus may prevent wafer slip to reduce CMP equipment maintenance costs. In addition, cost reduction and productivity may be improved due to prevention of waver loss.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A membrane coating compound for a chemical mechanical polishing (CMP) process, the membrane coating compound comprising:

a functional group capable of hydrogen bonding, wherein the functional group capable of hydrogen bonding includes a functional group having a catechol structure.

2. The membrane coating compound for the CMP process as claimed in claim 1, wherein the functional group capable of hydrogen bonding further includes an amine group.

3. The membrane coating compound for the CMP process as claimed in claim 2, wherein the compound includes a polymer having a molecular weight of 1,000 to 100,000.

4. The membrane coating compound for the CMP process as claimed in claim 1, wherein the compound includes dopamine, tyrosine, dihydroxyphenylalanine, norepinephrine, epinephrine, normetanephrine, 3,4-dihydroxyphenylalanine, a 3,4-dihydroxyphenylacetic acid, a tannic acid, a pyrogallic acid, or a combination thereof.

5. The membrane coating compound for the CMP process as claimed in claim 4, wherein the compound includes a polymer or a copolymer of dopamine, tyrosine, dihydroxyphenylalanine, norepinephrine, epinephrine, normetanephrine, 3,4-dihydroxyphenylalanine, a 3,4-dihydroxyphenylacetic acid, a tannic acid, a pyrogallic acid, or a combination thereof.

6. The membrane coating compound for the CMP process as claimed in claim 1, wherein the compound includes polydopamine.

7. A membrane structure for a chemical mechanical polishing (CMP) process, the membrane structure comprising:

a membrane; and a coating layer on a surface of the membrane, a wafer being fixable on the coating layer, wherein the coating layer includes a compound including a functional group capable of hydrogen bonding, wherein the functional group capable of hydrogen bonding includes a functional group having a catechol structure, and wherein the wafer is fixable by hydrogen bonding between the compound of the coating layer and the wafer.

8. The membrane structure for the CMP process as claimed in claim 7, wherein the coating layer is on a portion of the surface of the membrane.

9. The membrane structure for the CMP process as claimed in claim 8, wherein the coating layer is at an outer edge of the membrane.

10. The membrane structure for the CMP process as claimed in claim 9, wherein an area of the coating layer is 10 to 50 area %, based on a total area of the membrane.

11. The membrane structure for the CMP process as claimed in claim 9, wherein the coating layer includes:

an edge coating layer on the outer edge of the membrane, and inner coating layers on the membrane at predetermined intervals proximate to a center of the membrane.

12. The membrane structure for the CMP process as claimed in claim 11, wherein the inner coating layers are spaced apart from each other.

13. The membrane structure for the CMP process as claimed in claim 7, wherein the functional group capable of hydrogen bonding further includes an amine group.

14. The membrane structure for the CMP process as claimed in claim 13, wherein the compound includes a polymer having a molecular weight of 1,000 to 100,000.

15. The membrane structure for the CMP process as claimed in claim 7, wherein the compound includes dopamine, tyrosine, dihydroxyphenylalanine, norepinephrine, epinephrine, normetanephrine, 3,4-dihydroxyphenylalanine, a 3,4-dihydroxyphenylacetic acid, a tannic acid, a pyrogallic acid, or a combination thereof.

16. The membrane structure for the CMP process as claimed in claim 15, wherein the compound includes a polymer or a copolymer of dopamine, tyrosine, dihydroxyphenylalanine, norepinephrine, epinephrine, normetanephrine, 3,4-dihydroxyphenylalanine, a 3,4-dihydroxyphenylacetic acid, a tannic acid, a pyrogallic acid, or a combination thereof.

17. The membrane structure for the CMP process as claimed in claim 7, wherein the compound includes polydopamine.

18. A polishing apparatus for a chemical mechanical polishing process in which a wafer is holdable under pressure on the polishing apparatus, the polishing apparatus comprising:

a carrier;

a membrane below the carrier;

a coating layer between the membrane and the wafer; and a spindle mechanism that is coupled to the carrier and is rotatable, wherein the coating layer includes a compound including a functional group capable of hydrogen bonding, and wherein the functional group capable of hydrogen bonding includes a functional group having a catechol structure.

19. The polishing apparatus as claimed in claim 18, wherein the compound includes a polymer or a copolymer of dopamine, tyrosine, dihydroxyphenylalanine, norepinephrine, epinephrine, normetanephrine, 3,4-dihydroxyphenylalanine, a 3,4-dihydroxyphenylacetic acid, a tannic acid, a pyrogallic acid, or a combination thereof.

20. The polishing apparatus as claimed in claim 18, wherein a ratio of a radial width of the coating layer to a radial width of the membrane is in a range of 1/100 to 50/100.

* * * * *